US007753619B2

(12) United States Patent
Guntert, Jr. et al.

(10) Patent No.: US 7,753,619 B2
(45) Date of Patent: Jul. 13, 2010

(54) STRIKE-OFF BEAM AND SPREADER PLOW ASSEMBLY FOR PLACER/SPREADER

(75) Inventors: Ronald M. Guntert, Jr., Stockton, CA (US); Rick Francis, Stockton, CA (US)

(73) Assignee: Gutert & Zimmerman Const. Div., Inc., Ripon, CA (US)

( * ) Notice: Subject to any disclaimer, the term of this patent is extended or adjusted under 35 U.S.C. 154(b) by 136 days.

(21) Appl. No.: 12/243,670

(22) Filed: Oct. 1, 2008

(65) Prior Publication Data

US 2010/0129151 A1 May 27, 2010

Related U.S. Application Data

(62) Division of application No. 11/975,494, filed on Oct. 19, 2007, now Pat. No. 7,458,748, which is a division of application No. 11/078,689, filed on Mar. 10, 2005, now Pat. No. 7,311,465.

(51) Int. Cl.
*E01C 21/00* (2006.01)

(52) U.S. Cl. ..... 404/72; 404/75

(58) Field of Classification Search ..... 404/72, 404/75, 101, 105, 118
See application file for complete search history.

(56) References Cited

U.S. PATENT DOCUMENTS

| | | | | |
|---|---|---|---|---|
| 1,731,231 | A | | 10/1929 | Chenoweth |
| 1,993,657 | A | | 3/1935 | Gardiner |
| 3,252,390 | A | * | 5/1966 | Martinson ..... 404/102 |
| 3,540,359 | A | | 11/1970 | Swiser, Jr. et al. |
| 4,466,757 | A | | 8/1984 | Allen |
| 4,900,185 | A | | 2/1990 | Foertsch |
| 6,190,087 | B1 | | 2/2001 | Rower |
| 6,332,736 | B1 | | 12/2001 | Cape et al. |
| 6,390,727 | B1 | | 5/2002 | Guntert et al. |
| 6,422,785 | B1 | | 7/2002 | Ruggles et al. |
| 6,481,925 | B1 | | 11/2002 | Olson |
| 6,820,733 | B1 | | 11/2004 | Werner, Jr. |
| 7,316,552 | B2 | | 1/2008 | Haynes et al. |
| 2002/0044831 | A1 | | 4/2002 | Leone et al. |
| 2003/0108390 | A1 | | 6/2003 | Carlson |
| 2006/0285923 | A1 | | 12/2006 | Musil et al. |
| 2007/0065230 | A1 | | 3/2007 | Musil et al. |

* cited by examiner

*Primary Examiner*—Raymond W Addie
(74) *Attorney, Agent, or Firm*—Townsend and Townsend and Crew, LLP

(57) ABSTRACT

In combination with a placers/spreader having a frame including at least two side bolsters standing parallel to the subgrade path and at least two cross beams spanning the subgrade path forming a conveyor supporting structure. A rail system is attached spanning the frame, and has a roll in/roll out conveyor with a cantilevered support at one of the side bolsters and a support for attachment to and support from the rail system. The conveyor moves in traversing motion across the frame to distribute concrete. The improvement comprises a strike off beam and spreader plow assembly for trailing attachment to the frame of a placer/spreader. We thus disclose a strike off beam with spreader plow assembly which can be removably attached to either side of a placer/spreader to avoid the necessity of relocating the receiving conveyor when the location of the access road changes from one side to the other or direction of spreading changes. We additionally disclose a method of operation the strike off beam from a placer/spreader to prevent the accumulation of excess concrete the path of the following paver.

6 Claims, 10 Drawing Sheets

STRIKE-OFF BEAM AND SPREADER PLOW ASSEMBLY FOR PLACER/SPREADER

CROSS-REFERENCES TO RELATED APPLICATIONS

This is a divisional application of co-pending application Ser. No. 11/975,494, filed Oct. 19, 2007, which is a divisional application of application Ser. No. 11/078,689, filed Mar. 10, 2005, now U.S. Pat. No. 7,311,465 dated Dec. 25, 2007, the disclosures of which are incorporated by reference as if set forth herein.

BACKGROUND OF THE INVENTION

This invention relates to a strike-off beam and spreader plow assembly which can alternately be placed and supported spanning a subgrade to be paved behind a placer/spreader. More particularly, mounts are provided to removably mount the strike-off beam and spreader plow on either spanning side of the placer/spreader to permit the loading of concrete from either side of the placer/spreader. The mounts permit rapid transfer of the strike-off beam and spreader plow assembly to enable the placer/spreader to receive concrete from access roads on opposite sides of a subgrade being paved.

Slipform pavers are commonly utilized for paving reinforced and non-reinforced concrete roadways and airfield pavements. It is common practice for the concrete delivery trucks to back up on the subgrade and dump the contents of the truck on the subgrade in the path of a slipform paver and thereafter spread the placed concrete into the final profile of the specified concrete slab section. However, in some cases it is not possible for the trucks to drive on the subgrade of the roadway in the path of the slipform paver, and a separate access road must be employed alongside the road. In this case a placer/spreader can be utilized.

Access roads are required along the road subgrade when the subgrade in front of the slipform paver is not suitable or available for driving and dumping (such as when the subgrade is extremely porous, for example where superior drainage under the placed pavement is desired) or is too soft and thus not supportive enough for the concrete delivery trucks. Placer/spreaders are also utilized to receive and distribute concrete over the top of pre-placed dowel basket assemblies or continuous reinforcing bar reinforcement supported off and secured to the subgrade that would otherwise block the path of the concrete delivery trucks.

Placer/spreaders having roll in/roll out conveyors require occasional disassembly. Specifically, where the access road for concrete delivery is moved from one side of a paving path to an opposite side of the paving path, it is necessary to relocate the conveyor to the opposite side of the placer/spreader. In the prior art, this required removing the conveyor from its supporting frame, reversing the conveyor end for end, and reinstalling the conveyor to telescope into and out of the opposite side of the supporting frame.

In the mid-1960s, CMI Corporation (originally Construction Machinery Inc.) of Oklahoma City, Okla., manufactured a placer/spreader known as the PST 400 having the above-described construction with a roll in/roll out conveyor belt. Since then, another manufacturer copied this machine in its entirety. The machine included a main tractor frame with two side bolsters supporting an underlying concrete spreader auger with strike-off and an attached overlying power unit. The main tractor frame had an attaching rear bolster. Attached to the front of the main tractor frame was a conveyor supporting frame (conveyor module) which had an underlying roll in/roll out conveyor and attaching side bolsters. The entire assembly (main tractor frame and conveyor supporting frame) was supported on four bolsters with jacking columns and had crawler tracks at each corner of the entire assembly. Where the access road changed sides on the paving path, conveyor removal was required for relocation to the other side of the machine.

Additionally, this machine had superior function and productivity but was bulky, requiring multiple loads to be transported between job sites.

Specifically, three discrete loads require transportation. Further, both assembly and disassembly of the unit require a large crane assist. Regarding the loads, a first load includes the main tractor frame with the power unit and the underlying spreader auger assembly. A second load includes the conveyor supporting frame with the underlying roll in/roll out conveyor. A third and final load includes the disassembled front and rear bolsters, each with a jacking column and the supporting crawler track. Disassembly and assembly of the placer/spreader was and is very time-consuming, taking days to set up and tear down.

Moreover, the two discrete frames, each with two or more cross beams spanning the substrate, namely the conveyor support frame and tractor frame, required re-sectionalization when a width change of the placer/spreader is required, say to change the width from a standard 24-foot wide pavement to a 30-foot wide pavement. This too required a large crane assist and was very time-consuming, taking days to change the width.

This machine utilized spreader augers. Spreader augers utilized by the prior art are less than optimum. Typically, and because of the limits of the auger flighting and the mass of the auger, a central support bearing is required to support the auger from the main tractor frame. The supported auger includes opposed auger flights terminated at a central bearing. Further, such augers have a diameter in the range of up to three feet in order to be large enough to spread concrete rapidly. Finally, and assuming that more concrete is placed on one side of the auger support bearing than on the other side of the support bearing, redistributing concrete across the central support bearing of the spreader auger is problematic at best. Furthermore, spreader augers are dangerous and very costly to operate because of the auger fighting, and bearings wear out rapidly when conveying abrasive concrete.

BRIEF SUMMARY OF THE INVENTION

A placer/spreader made according to the present invention has a frame including at least two side bolsters standing parallel to the subgrade path and has at least two cross beams which span the subgrade path and form the conveyor supporting structure. A rail system is attached spanning the frame, and has a roll in/roll out conveyor with a cantilevered support at one of the side bolsters, and a support for attachment to and support from the rail system. The conveyor receives concrete (or other granular material) and, to allow trucks to pass the conveyor, moves in traversing motion across the frame to move out of the way and distribute concrete.

An improvement according to the present invention comprises a strike-off beam and spreader plow assembly for trailing attachment to the frame of the placer/spreader. The placer/spreader has a strike-off beam spanning the frame, and first and second attachment points on either side of the frame, the attachment points mating with the attachment bars of the strike-off beam. Attachments on the strike-off beam attach to either of the first and second attachment points on opposite sides of the frame. A separate spreader plow track is attached at the upper surface of a longitudinal support beam which supports the strike-off beam and has a spreader plow car movable along the spreader plow track from end to end of the plow track. A spreader plow blade is dependently mounted from the spreader plow car for plowing concrete side to side in advance of the strike-off beam. The improved spreader plow and strike-off beam can be quickly and easily reversibly mounted on opposite sides of the frame to receive concrete from either side of the machine without requiring conveyor disassembly.

We thus disclose a strike-off beam with spreader plow assembly which can be removably attached to either the front or the rear side of a placer/spreader to avoid the necessity of relocating the receiving conveyor when the location of the access road changes from one side to the opposite side of the machine. By disclosing this detachable assembly, we disclose the strike-off beam and spreader plow assembly which can optionally be used on one or the other side of the placer/spreader. The prior art has failed to recognize the utility of such a removably attached strike-off/spreader plow assembly.

We avoid the necessity of relocating the receiving conveyor when the location of the access road changes from one side to the opposite side of the machine. Relocating the receiving conveyor is extremely time-consuming and requires a large crane assist as opposed to relocating the strike-off beam with the spreader plow, which can be transferred rapidly without the need for a crane. Furthermore, by using a spreader plow, as opposed to an auger, in conjunction with the strike-off beam, the spreader plow with strike-off can be retracted close enough to the tractor frame so that the strike-off does not require separate removal for transport.

DETAILED DESCRIPTION OF THE INVENTION

Figure 1A:
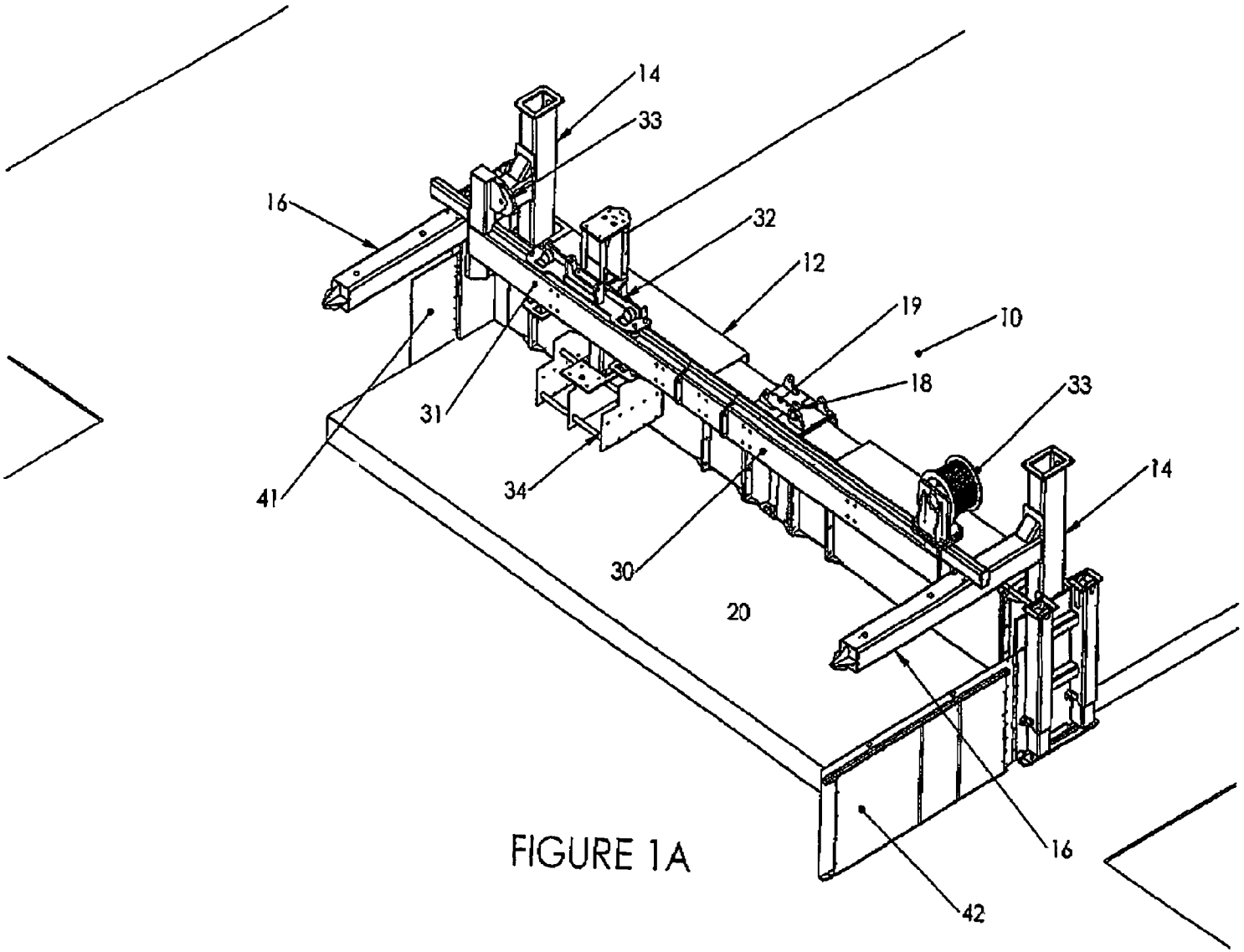
FIG. 1A is a perspective view of the strike-off beam and spreader plow—separate and apart from a placer/spreader—illustrating the strike-off beam in an extended working position with a spreader plow and supporting track operating from a position overlying the strike-off beam to spread concrete immediately before contact with the strike-off beam.

Referring to FIG. 1A, the strike-off beam and spreader plow assembly 10 is illustrated in perspective. Strike-off beam 12 has vertical supports 14 located at either end or side spanning placed concrete 20. Centrally of strike-off beam 12 there is placed hinge 18 which is articulated by hydraulic cylinder 19 to apply a berm profile to strike-off beam 12.

Vertical supports 14 have longitudinally extending male couplers 16 on either side of strike-off beam and spreader plow assembly 10. It is these male couplers 16 which enable engagement of the strike-off beam and spreader plow assembly 10 to either side of a placer/spreader.

Supported on male couplers 16 is spreader plow assembly 30. Spreader plow assembly 30 includes a spanning rail 31, a spreader plow car 32 with a plow blade 34 which rides on rail 31 in spanning movement, and a reel and cable (such as a wire rope winch) movement system 33 for moving the depending spreader plow blade 34. When strike-off beam and spreader plow assembly 10 are attached to a placer/spreader, plow blade 34 spreads concrete with its side-to-side movement while strike-off beam 12 assures the ultimate profile to the roughly placed concrete for forming into a road profile by a following paver.

Mud guards 41, 42 are provided at either side. These mud guards prevent placed concrete from being spread outside of the path of the placer/spreader. It will be noted that mud guard 42 is longer than mud guard 41. This is because mud guard 41 is adjacent the telescoping conveyer of the placer/spreader. They can be quickly interchanged when transferring the strike-off beam and spreader plow assembly from one side of the placer spreader to the other side.

Figure 1B:
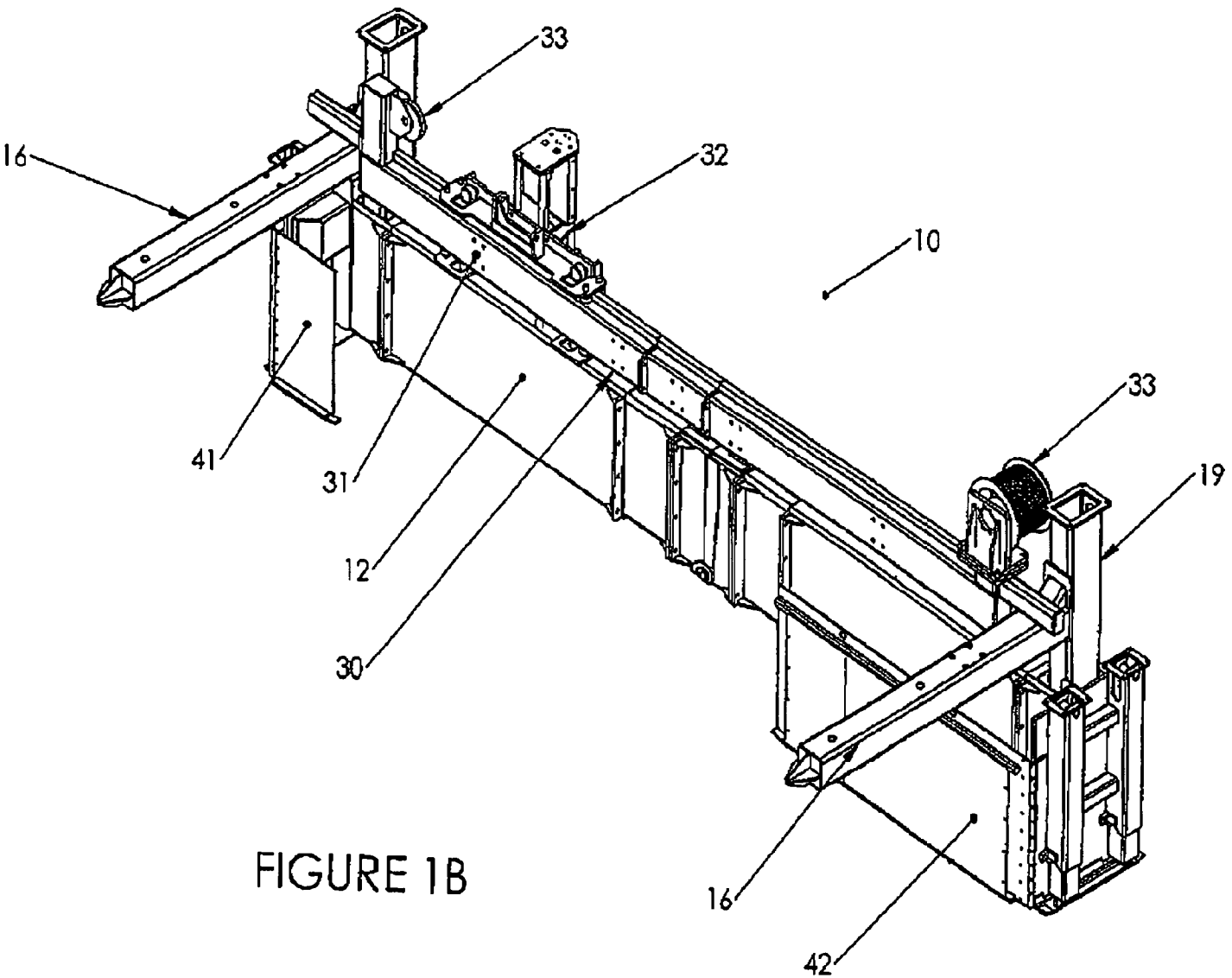
FIG. 1B is a perspective view of the strike-off beam and spreader plow—separate and apart from the placer/spreader—illustrating the strike-off beam in a collapsed transport position with a spreader plow and supporting track stowed overlying the strike-off beam for nesting immediately adjacent a placer/spreader during transport.

Referring to FIG. 1B, it is necessary for strike-off beam and spreader plow assembly 10 to be nested immediately adjacent to the placer/spreader for transport. This being the case, spreader plow blade 34 (not shown in FIG. 1B) is removed from spreader plow car 32. Respective mud guards 41, 42 are disposed inwardly on hinges. Finally, spanning rail 31 is moved immediately adjacent to vertical supports 14. As will hereafter be apparent, nesting of the strike-off beam and spreader plow assembly 10 immediately adjacent to the placer/spreader can occur. This nesting is required for the single trailer transport of the compact placer/spreader utilized with this invention.

Figure 2:
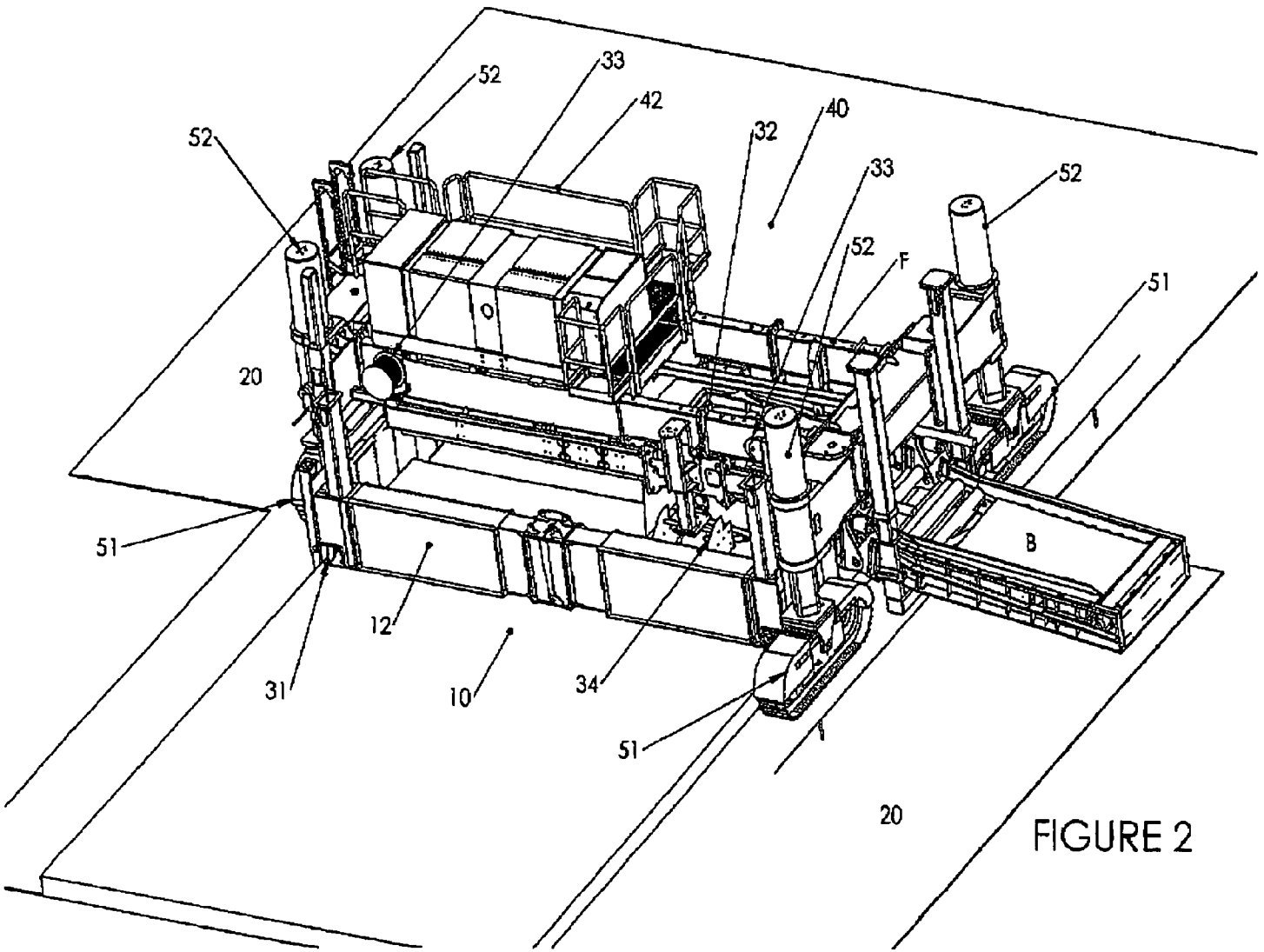
FIG. 2 is a perspective view of the strike-off beam spreader plow assembly attached to a placer/spreader for first spreading of concrete using the plow and a second distribution of concrete utilizing the strike-off beam.

Referring to FIG. 2, strike-off beam and spreader plow assembly 10 is shown in an operating disposition connected to but separate from a placer/spreader 40. Placer/spreader 40 includes a machinery module 42 supported on a frame F. Telescoping into and out of frame F is belt B, which receives concrete from a dump truck on access road 20 when telescoped out from under frame F. Unfortunately, access roads can change sides relative to the path to be paved. It is this condition that is illustrated in FIG. 2. The problem to be solved is how to accommodate this shift in sides. In FIG. 2, placer/spreader 40 is proceeding upward and to the right. It has reached the end of right-hand side access road 20 and is coming upon left-hand side access road 20. Clearly, if belt B telescopes to the same side, it will not be able to gather concrete from transporting trucks once right-hand access road 20 ends.

The prior art has solved this problem by removing the telescoping belt B from frame F and relocating the belt to the opposite side. This has extreme assembly and disassembly complications. We provide a simpler solution as follows.

Figure 3A:
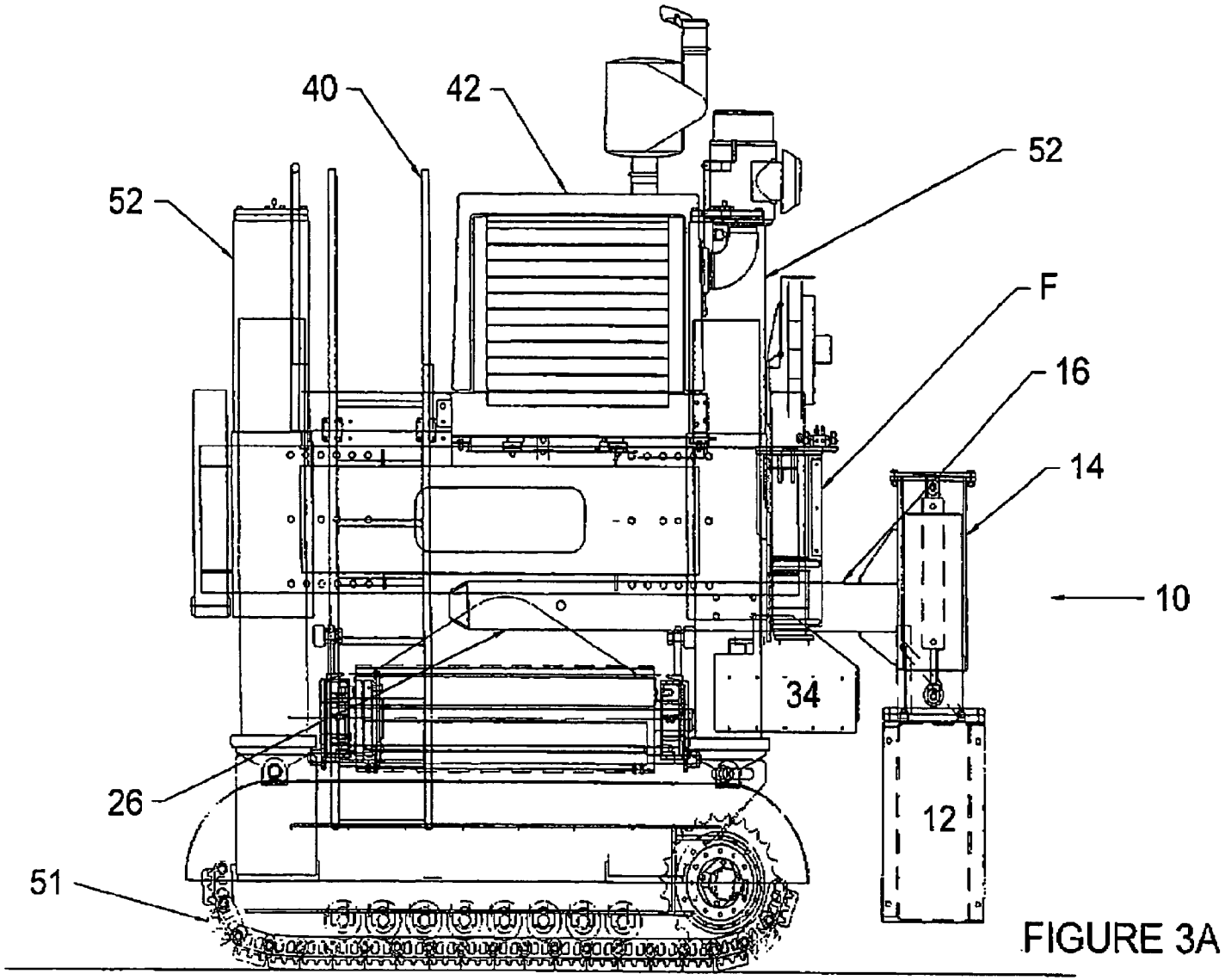
FIGS. 3A and 3B are respective side elevations and plan views of the strike-off beam spreader plow assembly attached at the back of a placer/spreader with the spreader plow operative to distribute concrete immediately before concrete distribution and the strike-off beam.
Figure 3B:
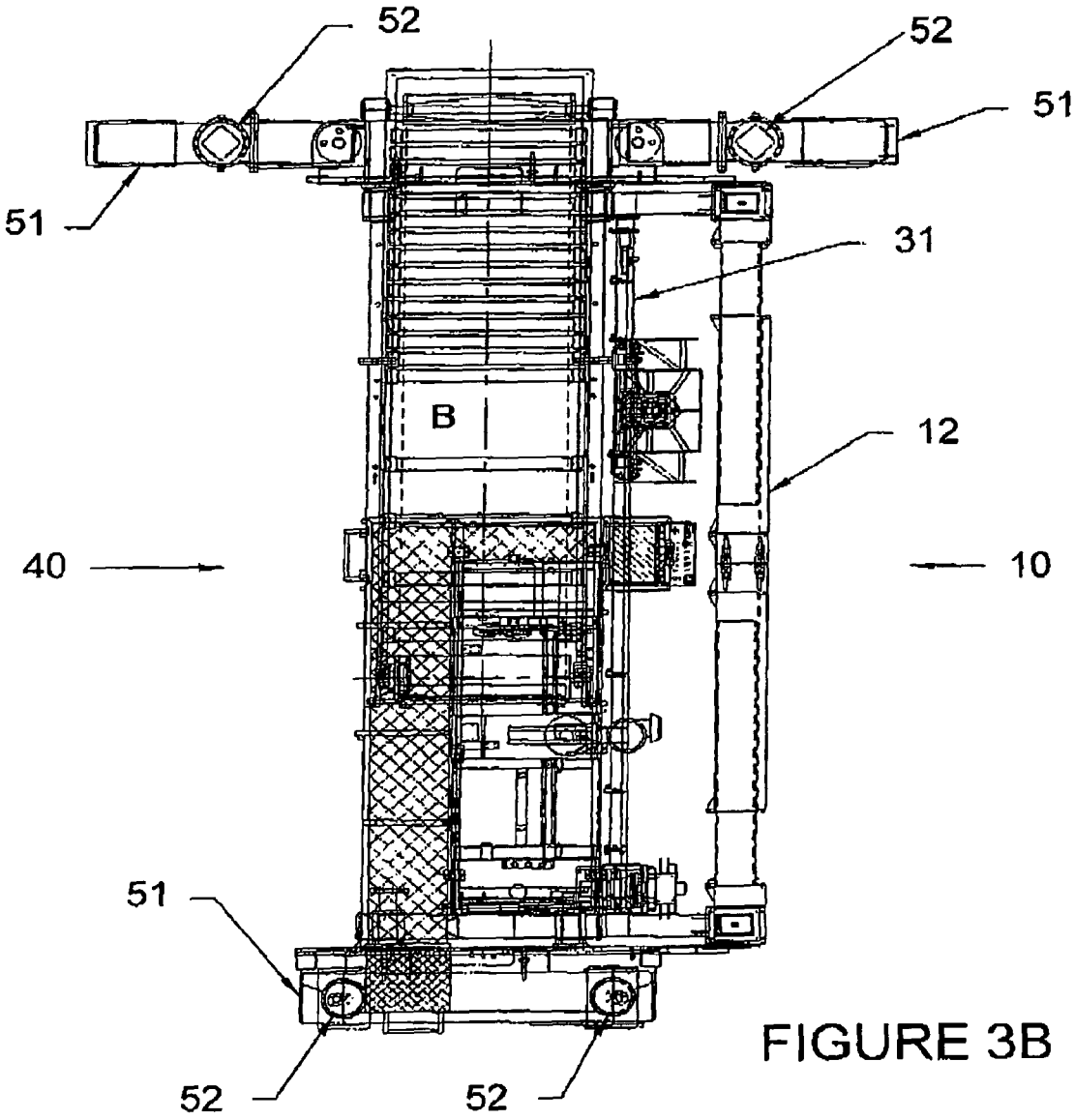

Referring to FIGS. 3A and 3B, placer/spreader 40 is shown respectively in side elevation with large single crawler 51 having two jacking columns 52 blocking an end of frame F.

Strike-off beam and spreader plow assembly 10 is conventionally attached with male couplers 16 penetrating the interior of female couplers 26 carried on placer/spreader 40. FIG. 3B illustrates that belt B telescopes out of frame F to the upper portion of the plan view shown. FIG. 3B also shows the side of the placer/spreader where the belt B is supported. This side of the machine has two jacking columns 52 with two crawler tracks 53 which allows the belt B to pass between them.

Figure 4A:
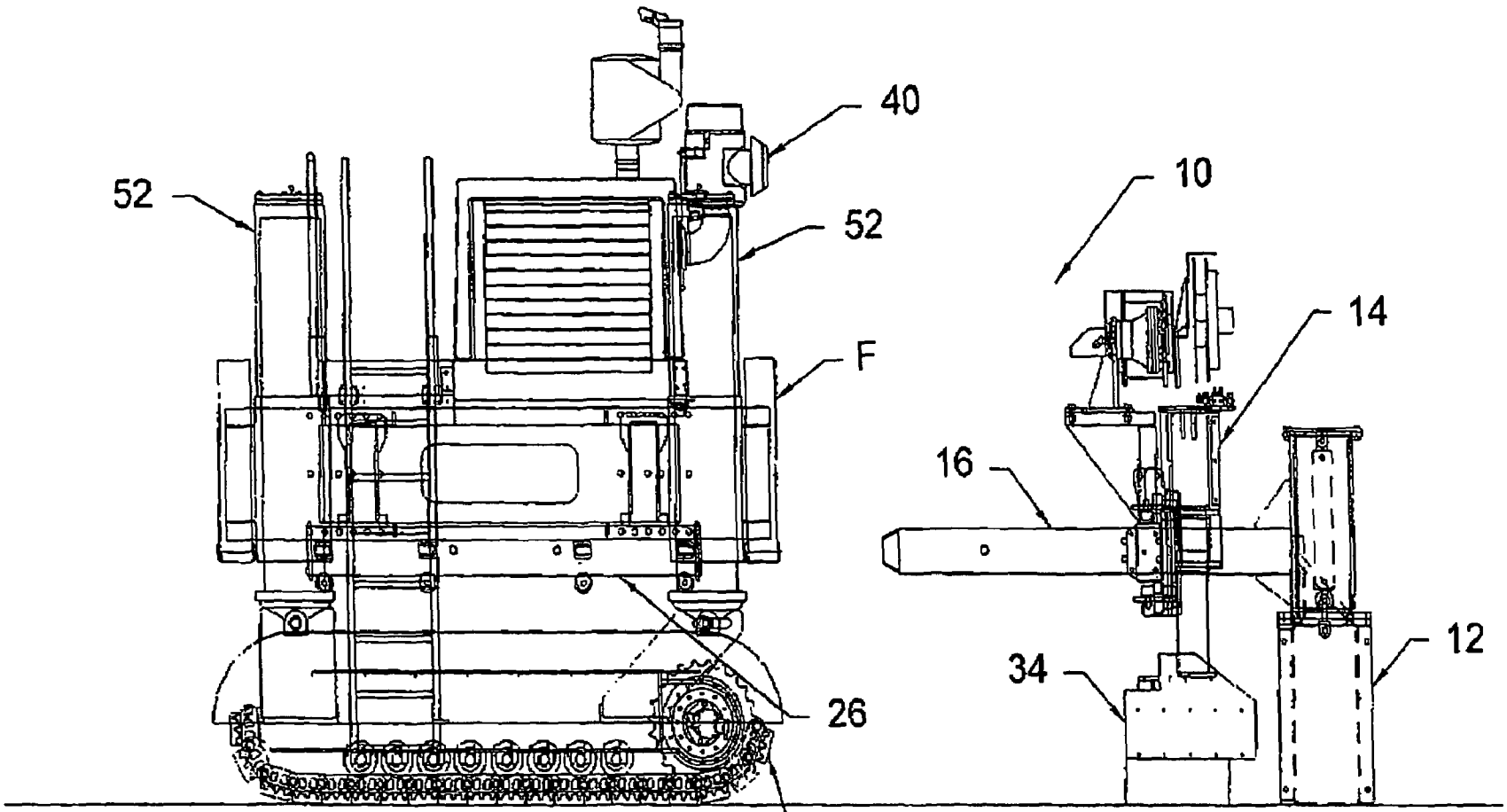
FIGS. 4A and 4B are respective elevation and plan views of a placer/spreader disengaged from the strike-off beam spreader plow assembly.
Figure 4B:
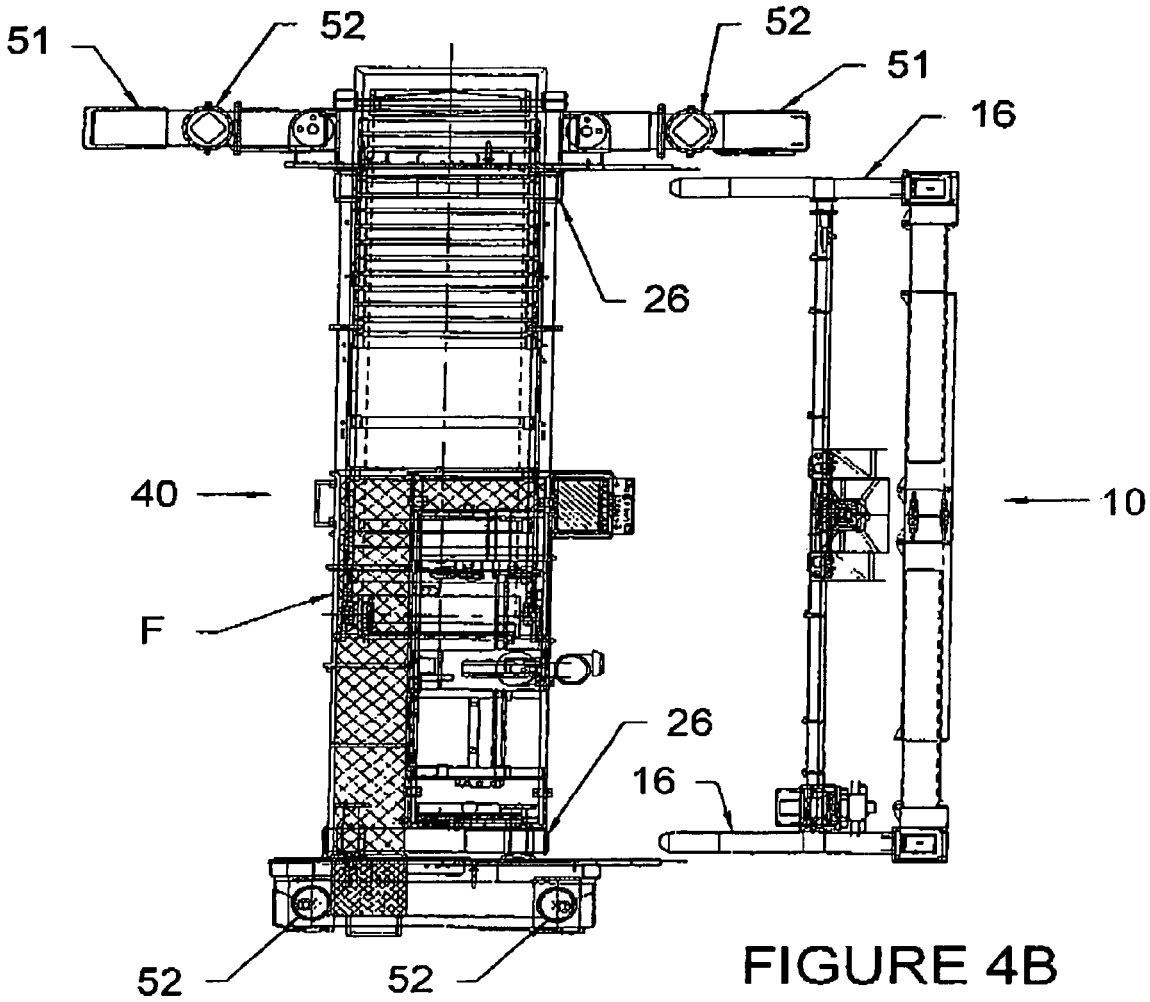

Referring to FIGS. 4A and 4B, male couplers 16 have been disconnected (typically by the removal of pins (shown) or loosening of clamps) from female couplers 26 attached to the underside of the placer/spreader frame 40, and the spreader plow track 31 has been unbolted from the placer/spreader frame. Strike-off beam and spreader plow assembly 10 has been lowered to the ground by the plow spreader and/or the vertical strike-off beam supports 14 and has been allowed to freely stand on strike-off beam 12 and spreader plow blade 34 with the aid of supporting block(s) 35. In the view shown, strike-off beam and spreader plow assembly 10 is now a free-standing unit completely detached from placer/spreader 40.

Figure 5A:
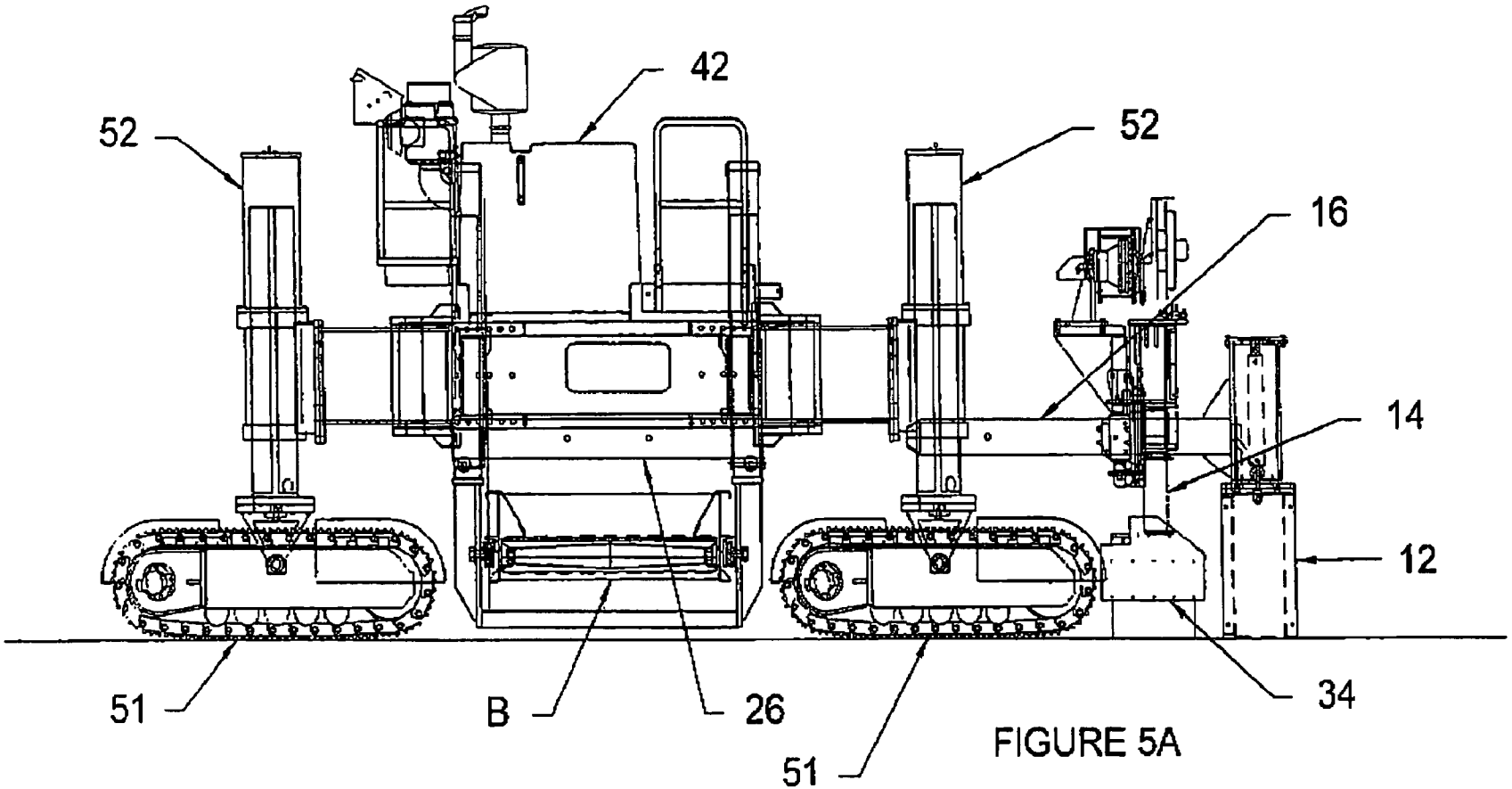
FIGS. 5A and 5B are respective elevation and plan views of the placer/spreader shown in FIGS. 4A and 4B having the placer/spreader reversed and approaching the strike-off beam and spreader plow assembly from the opposite side.
Figure 5B:
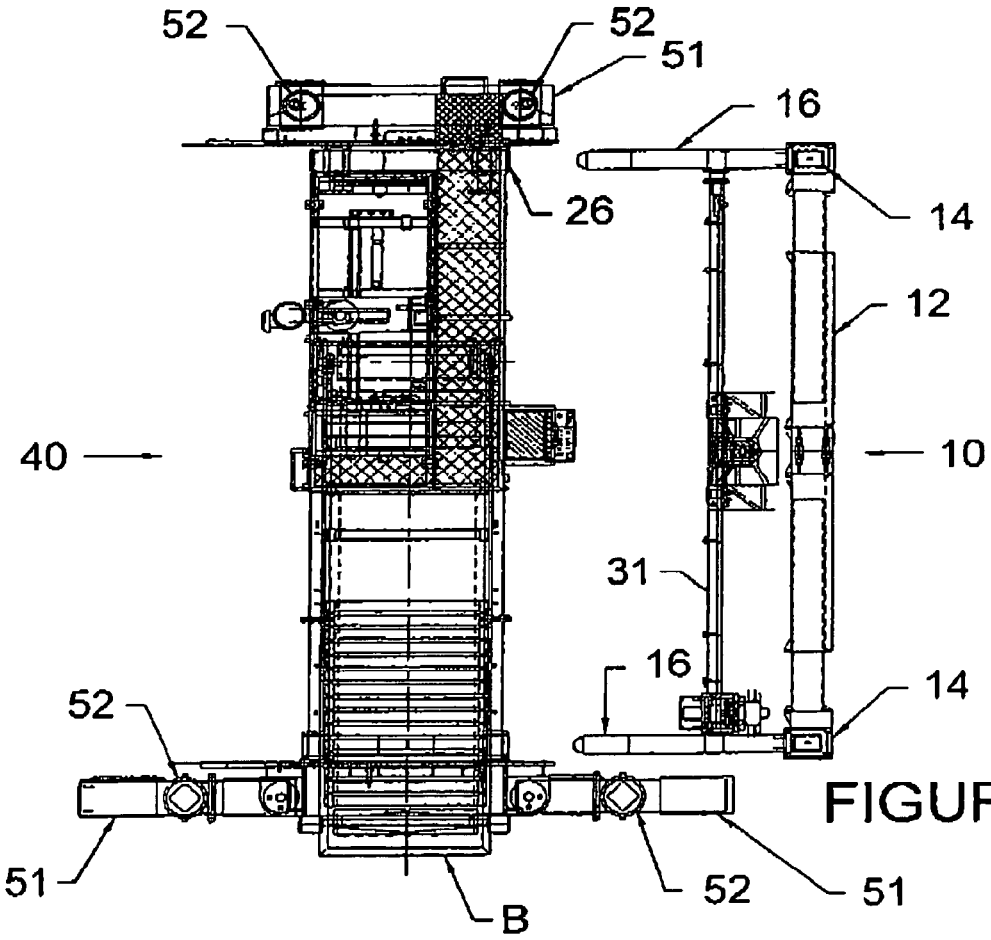

Referring to FIGS. 5A and 5B, spreader/placer 40 has been driven away and turned around. Thereafter, it has been returned to confront strike-off beam and spreader plow assembly 10 at female coupler 26 opposed to male coupler 16 on strike-off beam and spreader plow assembly 10.

Figure 6A:
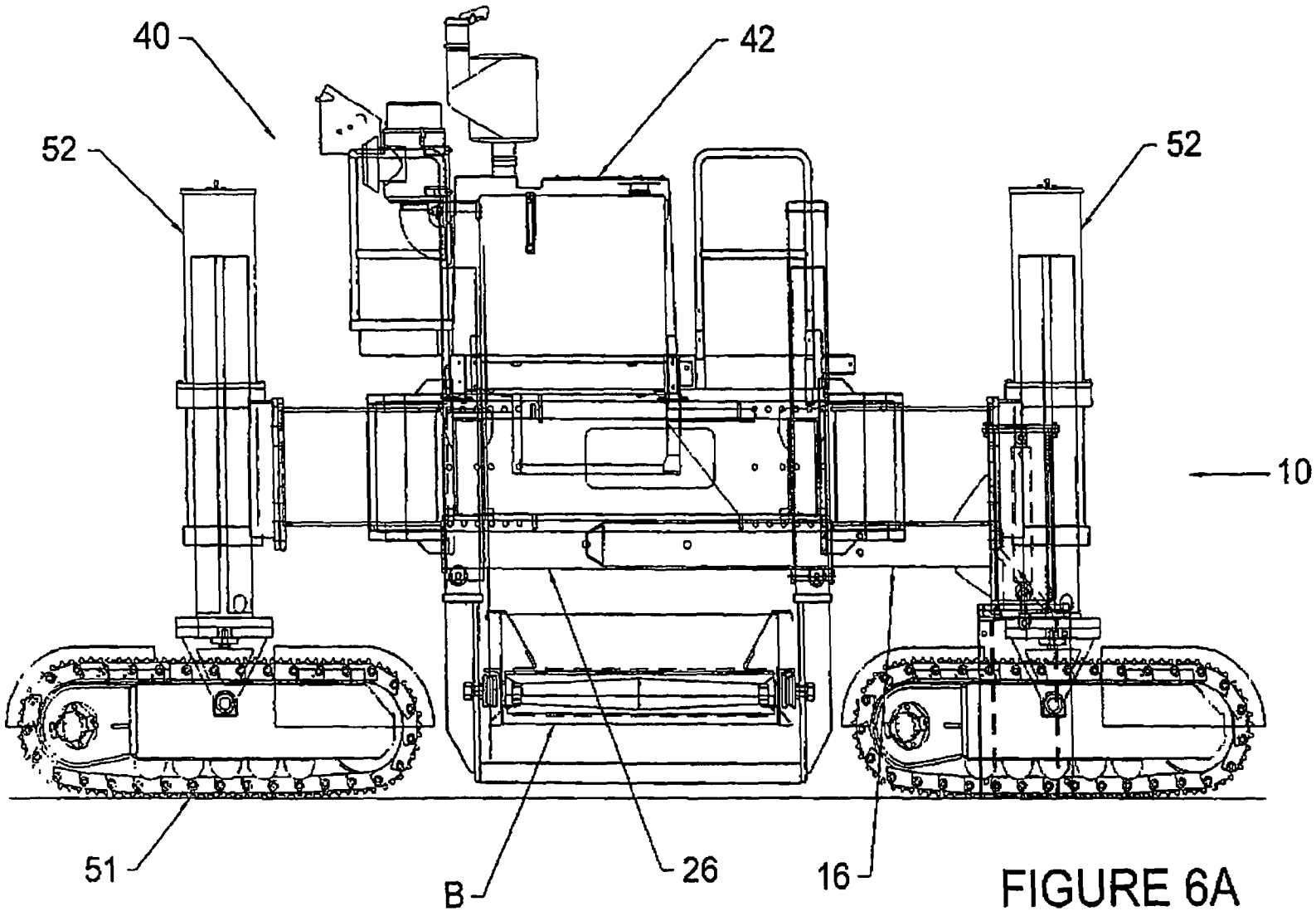
FIG. 6A is an elevation of the placer/spreader shown in FIGS. 5A and 5B having the placer/spreader turned 180 degrees and re-engaged to the strike-off beam spreader plow assembly in the opposite direction.

Finally, and with respect to FIG. 6, reengagement of placer/spreader 40 with strike-off beam and spreader plow assembly 10 is illustrated. Male couplers 16 have penetrated the interior of female couplers 26. Belt B now telescopes towards the viewer in FIG. 6 as distinguished from away from the viewer as shown in FIG. 3A. Reversal simply occurs.

To assist in aligning male couplers 16 with and penetrate the opening to the interior of female couplers 26, the hydraulic vertical supports 14 for strike-off beams 12 or the hydraulically powered jacking columns 52 can be raised or lowered.

What is claimed is:

1. A process for reversibly mounting a strike-off beam and spreader plow assembly on a frame of a placer/spreader for movement across a subgrade to be paved in a lateral direction between respective ends of the frame which are proximate first and second access roads lateral of the subgrade, the frame spanning the subgrade, the process comprising:

positioning the placer/spreader for receiving material to be placed on the subgrade from the first access road on a conveyor carried by the placer/spreader arranged on a side of the subgrade proximate the first access road and moving the conveyor to place the received material on the substrate to be paved;

providing the frame with attachment points at the respective ends of the frame and on either side of the frame;

providing a strike-off beam spanning the frame and extending across the width of the subgrade;

providing a spreader plow operatively connected with the strike-off beam and adapted to move in lateral directions between the respective ends of the frame relative to the strike-off beam to displace material in lateral directions over at least a portion of the subgrade;

providing attachment bars at respective ends of the strike-off beam for attachment to the attachment points at the respective ends of the frame;

attaching the attachment bars to the attachment points on one side of the frame to support the strike-off beam and spreader plow assembly from the frame;

supporting the strike-off beam and spreader plow assembly over the subgrade;

detaching the attachment bars from the one side of the frame;

reversing an orientation of the frame so that the attachment points on the other side of the frame face to the attachment bars; and, attaching the attachment bars to the attachment points on the other side of the frame whereby the position of the conveyor is changed from proximate the first access road to proximate the second access road so that the material can be supplied to the conveyor from the second access road.

2. A method for changing the position of a conveyor for receiving material to be spread over a ground surface and laying a longitudinal strip of pavement with the material on the ground, the conveyor protruding laterally from a frame including a placer/spreader for the material towards a first side of the pavement strip, a plurality of crawlers supporting the frame and adapted to move the frame in the longitudinal, downstream direction of the pavement strip while laying down the strip, a mechanism for retracting and extending the conveyor in a lateral direction relative to the pavement strip into and out of the frame, a strike-off beam and spreader plow assembly attachable to either one of first and second longitudinal ends of the frame, a first set of releasable connectors carried by the first and second longitudinal ends of the frame, and a second set of releasable connectors adapted to cooperate with the first set of releasable connectors and carried by the strike-off beam and spreader plow assembly, the method comprising configuring the first and second sets of connectors so that they are engageable and disengageable by moving the first and second set of connectors relative to each other in the longitudinal direction, engaging the first and second connectors at the first end of the frame, moving the strike-off beam and spreader plow assembly generally downwardly with respect to the frame towards the ground until the strike-off beam and spreader plow assembly is supported by the ground, moving the frame with the crawlers away from the strike-off beam and spreader plow assembly to thereby disengage the first and second set of connectors from each other at the first end of the frame, moving the conveyor from one side of the pavement strip to the other side thereof by moving the frame with the crawlers to reverse a longitudinal orientation of the frame so that the conveyor protrudes from the frame towards a second side of the longitudinal pavement strip, aligning the first set of connectors on the second end of the frame with the second set of connectors on the strike-off beam and spreader plow assembly by moving the frame with the crawlers relative to the strike-off beam and spreader plow assembly, engaging the first set of connectors on the second end of the frame with the second set of connectors on the strike-off beam and spreader plow assembly by moving the first set of connectors at the second end of the frame relative to the second set of connectors in the longitudinal direction, and thereafter continuing using the placer/spreader to lay down spreadable material in the longitudinal downstream direction by moving the frame with the second end thereof facing in the downstream direction while loading spreadable material onto the conveyor from adjacent the second side of the pavement strip.

3. A method according to claim 2 wherein moving the frame in the downstream direction comprises moving the frame with the crawlers in the downstream direction.

4. A method according to claim 2 wherein the first and second set of connectors include cooperating connector parts which extend in the longitudinal direction so that they can be engaged and disengaged by moving them relative to each other in the longitudinal direction.

5. A method according to claim 2 wherein one of the connector parts is a straight, elongated bar and the other one of the connector parts defines a tubular member adapted to receive the bar by moving the bar relative to the tubular connector linearly in the longitudinal direction.

6. A method according to claim 5 wherein the bar is secured to and carried by the frame and the tubular member is secured to and supported by the strike-off beam and spreader plow assembly.

* * * * *